United States Patent [19]

Winner

[11] Patent Number: 5,038,698

[45] Date of Patent: Aug. 13, 1991

[54] DAGGERFIN ADJUSTABLE SAILBOARD SKEG

[75] Inventor: William K. Winner, White Salmon, Wash.

[73] Assignee: BIC Corporation, Milford, Conn.

[21] Appl. No.: 414,801

[22] Filed: Sep. 29, 1989

[51] Int. Cl.[5] ..... B63B 35/79

[52] U.S. Cl. ..... 114/39.2; 441/79

[58] Field of Search ..... 441/79, 74; 114/127, 114/138, 141, 39.2, 130, 139, 140, 39.1

[56] References Cited

U.S. PATENT DOCUMENTS

| | | | |
|---|---|---|---|
| Re. 31,167 | 3/1983 | Schweitzer | 114/39 |
| 2,466,006 | 5/1949 | Danko | 114/138 |
| 3,110,281 | 11/1963 | Buck | 114/139 |
| 3,308,493 | 3/1967 | Lambach | 9/310 |
| 3,381,648 | 5/1968 | Vonck | 114/141 X |
| 3,455,261 | 7/1969 | Perrin | 114/39 |
| 3,516,100 | 6/1970 | Ellis | 9/315 |
| 3,564,632 | 2/1971 | Bahne | 9/310 |
| 3,579,681 | 3/1971 | Pope et al. | 9/310 |
| 3,585,663 | 6/1971 | Johnson | 9/310 |
| 4,161,796 | 7/1979 | Kostanecki | 114/39.1 X |
| 4,166,425 | 9/1979 | Kummetz | 114/39.2 |
| 4,280,428 | 7/1981 | Werner, Jr. | 114/39.1 |
| 4,316,425 | 2/1982 | Guido et al. | 114/141 |
| 4,421,492 | 12/1983 | Leva | 441/79 |
| 4,759,308 | 7/1988 | Zander | 114/127 |
| 4,759,552 | 7/1988 | Schütz | 277/12 |
| 4,805,546 | 2/1989 | Geller et al. | 114/132 |

FOREIGN PATENT DOCUMENTS

| | | | |
|---|---|---|---|
| 17231 | 10/1980 | European Pat. Off. . | |
| 310686 | 4/1989 | European Pat. Off. . | |
| 2924913 | 6/1979 | Fed. Rep. of Germany . | |
| 3147670 | 6/1983 | Fed. Rep. of Germany . | |
| 3440553 | 3/1985 | Fed. Rep. of Germany . | |
| 8906927 | 10/1989 | Fed. Rep. of Germany . | |
| 8914642 | 2/1990 | Fed. Rep. of Germany . | |
| 1123150 | 9/1956 | France | 114/39.1 |
| 2053507 | 4/1971 | France . | |
| 2614867 | 11/1988 | France | 114/127 |
| 204754 | 5/1966 | Sweden | 114/138 |
| 1008080 | 3/1983 | U.S.S.R. | 114/130 |
| 2053804 | 2/1981 | United Kingdom | 114/138 |

OTHER PUBLICATIONS

K. Rogers, "The Adjustable Fin", *Windsurf*, Sep. 1989, p. 61.

A. Pucher, "Steck's Weg", *Surf Magazine*, Sep. 1989, p. 40.

*Primary Examiner*—Sherman D. Basinger

*Attorney, Agent, or Firm*—Pennie & Edmonds

[57] ABSTRACT

A wind propelled sailing apparatus having a sailboard hull adapted to support a user; a sail for propulsion of the sailboard hull and adapted to receive wind for motive power; a skeg positioned and oriented in a rear central portion of the sailboard hull, the skeg being adjustable between a first position, whereby the skeg has a surface area sufficient to provide lateral resistance to side forces generated by the sail and to provide directional stability to the sailboard hull when sailing upwind, and a second position, whereby the area of the skeg is reduced for sailing downward; and a housing for the skeg which facilitates vertical upward and downward movement thereof, the housing having an opening configured and positioned about the skeg to minimize air entrainment between the housing opening and skeg to the underside of the sailboard hull due to forward movement thereof.

32 Claims, 4 Drawing Sheets

DAGGERFIN ADJUSTABLE SAILBOARD SKEG

TECHNICAL FIELD

The present invention relates to an adjustable area, vertically movable skeg which projects from the lower rear surface of a sailboard. I refer to this apparatus as a DAGGERFIN TM skeg.

BACKGROUND ART

Sailboards are generally constructed of a board of lightweight synthetic plastic material to which is pivotally attached a mast which supports a boom and sail. The mast, boom and sail are controllable by the user to convert wind to motive power for the sailboard.

The board includes a fin which is positioned on the lower, rearward, central underside of the board extending into the water. This fin is generally referred to as a skeg and is usually fixed in size, shape and position. The skeg provides hydrodynamic forces which combine with the aerodynamic forces on the sail to provide motive power to the board. Such skegs are used with all sailboards.

For boards longer than about 10½ feet, an adjustable area keel positioned generally in the lower center of the board is also used. Such keels are known as centerboards or daggerboards. A typical centerboard is about two feet in span and about 6 inches in chord, while a typical skeg is about eleven inches in span and four inches in chord. U.S. Reissue Pat. No. 31,167 illustrates a typical sailboard which uses both a centerboard and skeg.

Centerboards also provide hydrodynamic forces which combine with the forces generated by the sail to produce a net force which is in the direction of motion of the sailboard. When a centerboard is not used, however, the skeg is the sole means for providing not only directional stability to the sailboard but also lateral resistance.

A profound effect on the performance of the sailboard can be achieved by varying the sizes, shapes and locations of these fins and keels. A fin and/or keel configuration that is fast for one point of sail or wind strength may be slow on another. For example, a sailboard equipped with a centerboard can sail upwind much better than a sailboard which is equipped only with a standard skeg.

The present invention provides an improved skeg construction for optimizing both the upwind and downwind sailing performance of sailboards utilizing same, when such sailboards do not utilize a centerboard.

SUMMARY OF THE INVENTION

The present invention relates to a wind propelled sailing apparatus comprising a sailboard hull adapted to support a user and means for propulsion of the sailboard hull and adapted to receive wind for motive power. The propulsion means generally is a sail, and the apparatus includes a skeg positioned and oriented in a rear central portion of the sailboard hull. The skeg is adjustable between a first position, whereby the skeg has a surface area sufficient to provide lateral resistance to side forces generated by the propulsion means and to provide directional stability to the sailboard hull when sailing upwind, and a second position whereby the area of the skeg is reduced for sailing downwind. The adjustable skeg of the invention provides the necessary lateral resistance and directional control for those sailboards which do not include a centerboard.

The apparatus preferably includes means for housing the skeg and facilitating vertical upward and downward movement thereof. The housing means has an opening configured and positioned about the skeg to (1) minimize air entrainment between the housing opening and skeg to the underside of the sailboard hull due to forward movement thereof, and (2) prevent water from being forced upward through the opening from beneath the sailboard hull. The housing advantageously includes means for contacting the skeg to further reduce air entrainment and water flow between the housing opening and skeg, with the contacting means preferably comprising a flexible seal member made of resilient polyurethane foam.

The apparatus further includes means for prevention of downward vertical movement of the skeg beyond a predetermined distance which corresponds to the first position. This skeg movement prevention means comprises a lip portion on the upper end of the skeg which is operatively associated with the housing opening. Depending upon the specific embodiments disclosed herein, such skeg movement prevention means may further comprise a pad member mounted upon the upper surface of the sailboard hull, or a seat member located within the housing opening.

The apparatus also includes means for prevention of upward vertical movement of the skeg beyond a predetermined distance corresponding to the second position. This skeg movement prevention means can be a strap member connected between the skeg and the housing to limit the uppermost position of the skeg. Instead, the lower portion of the skeg can be dimensioned slightly wider then the housing opening to prevent the additional upward movement. Such means also prevents the skeg from being pulled out of the housing by the user, or expelled from the housing in the event of an upset of the sailboard.

Preferably, the skeg includes means located on the upper end thereof for the raising or retraction of the skeg from the first position towards the second position. When the skeg includes a lip portion on the upper end thereof, the skeg raising means may comprise a strap member connected to the lip portion. If desired, the housing may extend beneath the sailboard hull for providing a fixed skeg which imparts a minimum amount of directional stability to the apparatus when the skeg is raised to the second position.

A preferred skeg raising means is an L-shaped foot control operatively associated with the lip portion of the skeg. This foot control is pivotably mounted upon the sailboard hull, and includes a U-shaped foot pedal and a pair of arm members attached thereto at a predetermined angle. By stepping on the foot pedal with the appropriate amount of force, the arm members move upwardly to engage and lift the lip portion of the skeg, thus raising the skeg from the first position to the second position or to any point therebetween.

BRIEF DESCRIPTION OF THE DRAWINGS

The nature, advantages and various other additional features of the preferred embodiments of the invention will appear more fully upon consideration of the attached drawing figures, wherein.

DETAILED DESCRIPTION OF THE PREFERRED EMBODIMENTS

Figure 1:
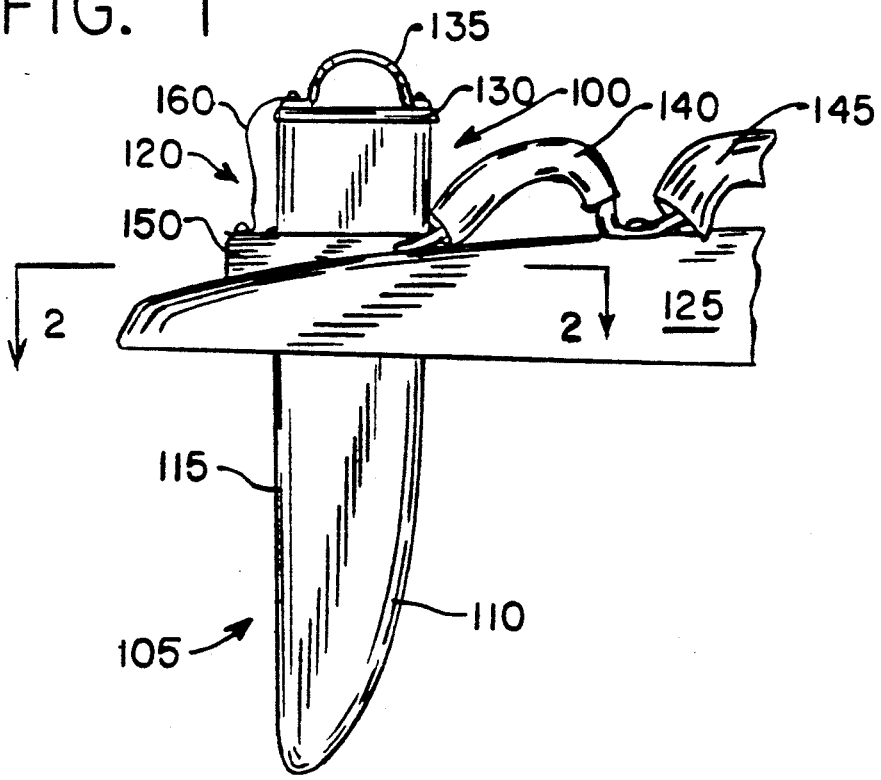
FIG. 1 is a side view of a first embodiment of a DAGGERFIN TM skeg in accordance with the present invention.
Figure 2:
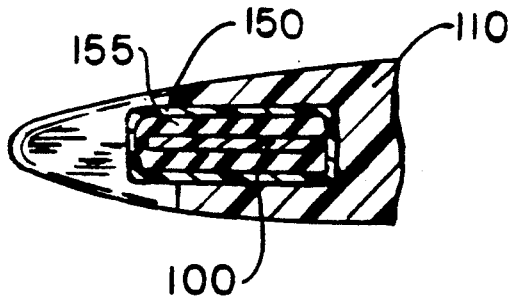
FIG. 2 is a cross-sectional view of the skeg and sailboard of FIG. 1 taken along lines 2—2 of FIG. 1.

Referring initially to FIGS. 1 and 2, there is illustrated a DAGGERFIN TM skeg 100 which is made of molded or laminated plastic material. The skeg is shaped in such a manner that it has a uniform cross-section area for the portion that passes through the board, as well as a tapered lower portion 105. The front 110 and rear 115 edges of the skeg 100 are shaped and configured to decrease the hydrodynamic drag forces thereupon. The movement of the sailboard along the water allows the skeg to generate a force which opposes that imparted to the board from the sail. The forces which are generated by the sail in a direction sideways or perpendicular to the board are effectively cancelled by the forces generated by the skeg. Thus, the movement of the board 125 is in a forward direction, i.e., the direction that the sailboard is pointing.

The skeg 100 is vertically movable so that the length of the lower portion 105 can be adjusted by the user of the board 125. In the lowest position, the lower portion 105 of the skeg 100 extends about 18" below the board 125. The greatest extension of the skeg 100 creates the greatest drag on the speed of the sailboard 125, so that the slowest speeds are achieved in this position. This position also greatly facilitates operation of the sailboard upwind.

The top portion 120 of the skeg 100 includes a lip portion 130 which is wider than the slot through which the skeg 100 moves vertically. Thus, lip portion 130 prevents the skeg 100 from being pushed downward through the board or from being pulled out from the lower side of the board. Top portion 120 also includes a strap 135 attached to the forward and rearward ends of the lip portion 130 so as to provide a loop which can be grasped by the foot or hand of the user. As the user desires to gain speed or when operating the sailboard downwind, the skeg 100 is pulled upwardly by exerting an upward force on strap 135 by the user's foot or hand. A reduced extension length of about 11 to 12 inches for the skeg is generally desirable for most sailboarding. This allows the sailboard to achieve the highest speeds.

As noted above, the skeg 100 is placed in housing 150 on the rearward end of the sailboard behind the rearmost foot straps 140, 145. This housing 150 includes an opening which is configured to be both longer and wider than the width and length of skeg 100 to allow for vertical movement thereof. The opening of the housing should be sufficient to allow vertical movement of skeg 100, but should not be oversized, since too large an opening could cause air to be sucked down to the underside of the board. This phenomenon, known as skeg ventilation, is particularly troublesome to sailboards because the entrainment of air on the underside or low pressure side of the skeg results in a severe reduction of lateral resistance. To overcome this problem, the opening in the housing is made at the minimum dimension which still allows the skeg 100 to vertically move upward and downward. In addition, a resilient seal member 155 should be provided, as best illustrated in FIG. 2, to minimize such air entrainment. This seal member 155 is preferably made of a flexible polyurethane foam which can conform to the shape of the skeg. Thus, the foam has sufficient resiliency to form an air-tight seal around the skeg 100 while also allowing the skeg to be moved vertically upward or downward. This seal member 155 also prevents water from being forced upward through the housing opening.

Skeg 100 also includes upward movement prevention means in the form of a connecting cord or strap 160 extending from the lip portion 130 to the housing 150. Strap 160 prevents the skeg 100 from being accidentially or intentionally removed from housing 150. Alternatively, instead of strap 160, the lower portion 105 of skeg 100 can be configured and dimensioned to be wider than the housing opening. In addition to preventing removal of the skeg, this wider portion assists in preventing air entrainment and water flow between the skeg and housing opening when the skeg is placed in its uppermost (i.e.—second) position.

Figure 3:
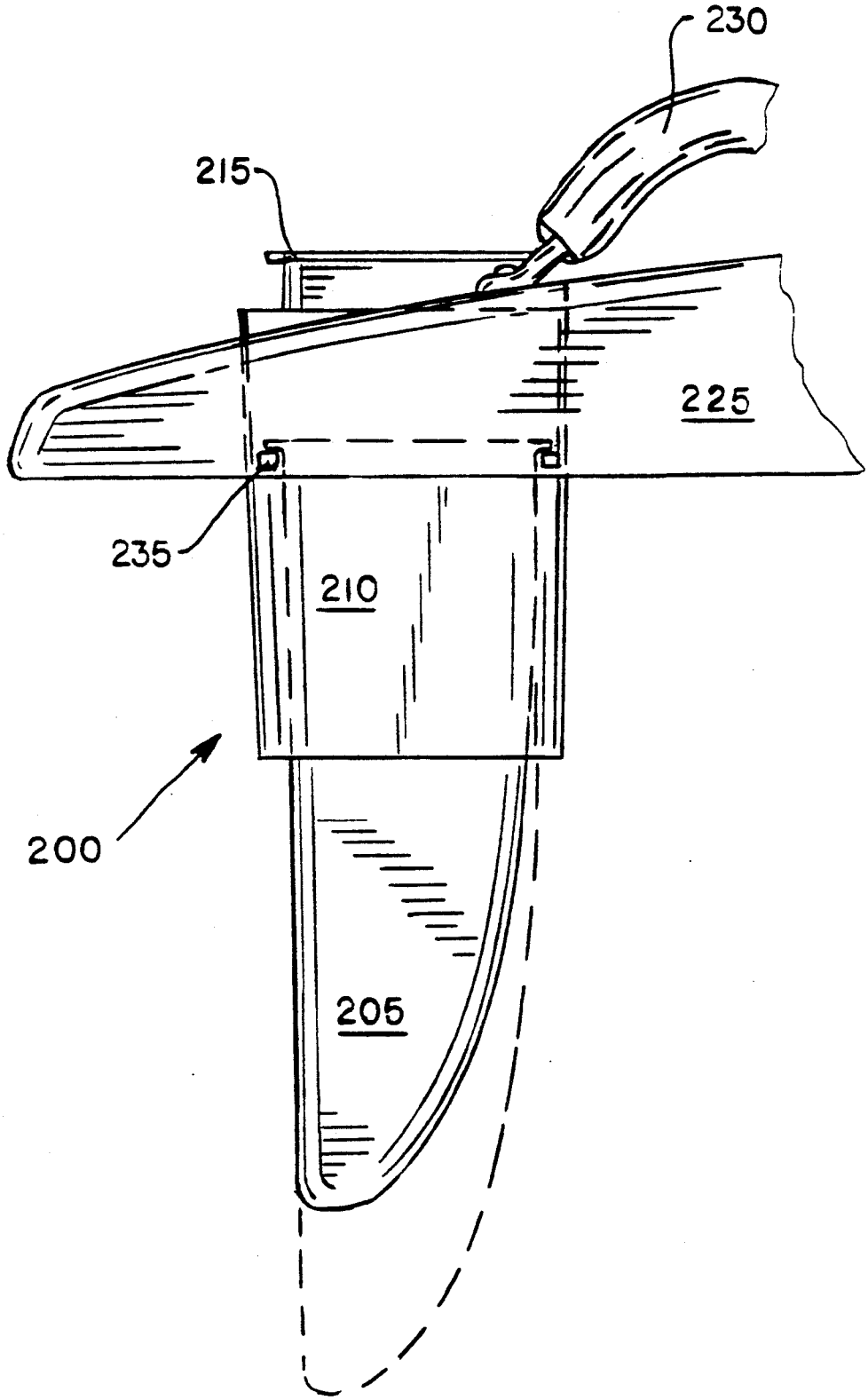
FIG. 3 is a side view of an alternate embodiment of a DAGGERFIN TM skeg in accordance with the present invention, which illustrates a skeg housing which maintains a minimum skeg surface area beneath the sailboard.

Referring now to FIG. 3, there is illustrated an alternate embodiment of the DAGGERFIN TM skeg 200 of the invention. In this embodiment, skeg 205 is vertically adjustable in a housing 210 which provides a permanent extension below the bottom of sailboard 225. This housing 210 acts as a support structure that allows skeg 205 to operate entirely within the sailboard and not extend above the deck thereof. This DAGGERFIN TM skeg 205 includes lip portion 215 and is again mounted rearward of foot strap 230. Lip portion 215 engages an interior ledge 235 of the housing, which ledge provides a stop for the lowest position of the skeg 205. This embodiment is less preferably to that of FIG. 1, since the housing extension is redundant to the skeg when the skeg is in its uppermost position.

Figure 4:
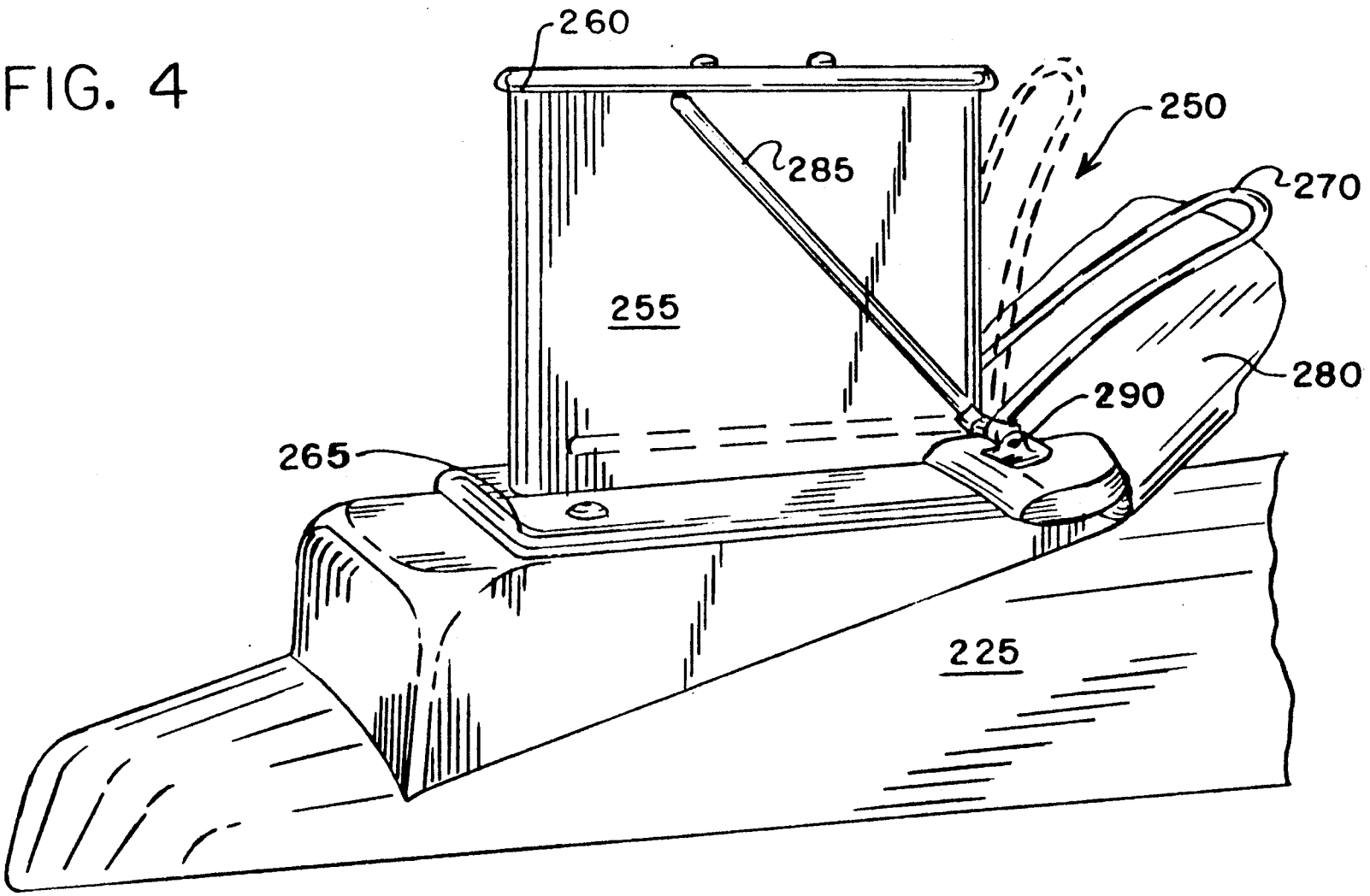
FIG. 4 is a perspective view of another embodiment of a DAGGERFIN TM skeg, which is operated by a foot control to adjust the length of the skeg which extends into the water.
Figure 5:
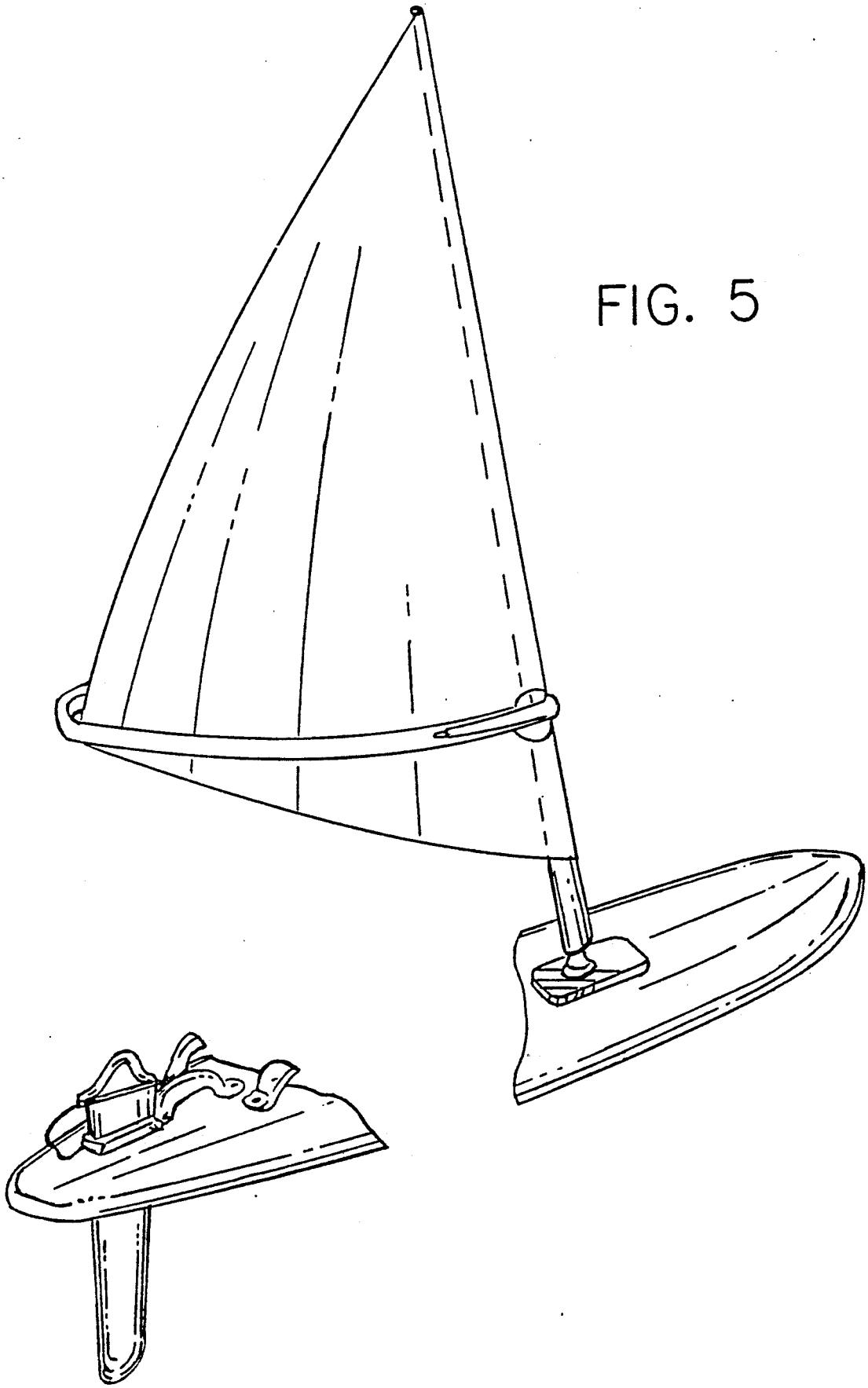
FIG. 5 is a perspective view of a sailboard in accordance with the invention.

Referring now to FIG. 4, there is illustrated a foot control 250 which is used for raising the DAGGERFIN TM skeg 255 from its lowest position, i.e., the first position where lip portion 260 is adjacent pad member 265, to a higher position. This skeg raising operation effectively reduces the surface area of the skeg which is beneath the water so that faster speeds or better downwind sailing may be achieved. Also, pad member 265 is mounted on top of housing 295 to assist in reducing air entrainment therein. Also, if desired, a seal member similar to that of FIG. 2 should be included in housing 295 for reduction of an air entrainment or water movement through the housing opening.

Foot control 250 includes a U-shaped foot pedal 270 which is mounted to the sailboard 275 at the same location as foot straps 280. Foot pedal 270 is rigidly attached to a pair of elongated arm members 285, one on each side of skeg 255. The foot pedal 270 and arm members 285 are fixed at a predetermined angle and are pivotable about point 290. Although an angle of substantially 90° is illustrated, other angles can be used, if desired, depending upon the length of skeg to be raised from the first position to the second position or to any point therebetween. Foot pedal 270 and arm members 285 are constructed of a rigid material that is resistant to seawater. Stainless steel is preferred although certain high strength engineering thermoplastics could be used instead.

In operation, the user sets the skeg 255 at its lowermost, fully extended (i.e. first) position whereby lip portion 260 is adjacent plate member 265. Arm members 285 and foot pedal 270 thus are placed in the position shown in phantom in FIG. 4. Foot pedal 270 extends in a substantially vertical direction where it can easily be moved by the user's foot to lift the skeg 255 by the upward movement of arm members 285 upon lip portion 260. Further depression of foot pedal 270 causes arm members 285 to be moved further upward, with a corresponding upward movement of skeg 255. In this embodiment, skeg 255 may or may not utilize a strap member for retraction, since the raising of the skeg by the foot control 250 places the upper portion of the skeg in any position up to its uppermost position (i.e., the second position).

It is understood that foot control 250 is operable with any of the preceding embodiments and that the skeg of FIG. 4 can include a top strap and a connecting strap, if desired. For optimum performance, a polyurethane seal member should be included in each embodiment to minimize or prevent air entrainment beneath the sailboard and to prevent water from being forced upward through the housing opening from below the sailboard.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. A wind propelled sailing apparatus comprising a sailboard hull adapted to support a user; means for propulsion of said sailboard hull and adapted to receive wind for motive power; a skeg positioned and oriented in a rear central portion of said sailboard hull as the sole means for providing lateral resistance and directional control for the apparatus, said skeg being adjustable between a first position, whereby said skeg has a surface area sufficient to provide lateral resistance to side forces generated by said propulsion means and to provide directional stability to said sailboard hull when sailing upwind, and a second position, whereby the area of the skeg is reduced for sailing downwind; and means for housing said skeg and facilitating vertical upward and downward movement thereof, said housing means having an opening configured and positioned about said skeg to minimize air entrainment between said housing opening and skeg to the underside of the sailboard hull due to forward movement thereof and to prevent water from being forced upward through the housing opening from beneath the sailboard hull; wherein said housing extends beneath said sailboard hull for providing directional stability to said apparatus when said skeg is retracted toward said second position.

2. The apparatus of claim 1 further including means for prevention of downward vertical movement of said skeg beyond a predetermined distance corresponding to said first position.

3. The apparatus of claim 2 wherein said skeg downward movement prevention means comprises a lip portion on the upper end of said skeg which is operatively associated with said housing opening.

4. The apparatus of claim 3 wherein said skeg downward movement prevention means further comprises a pad member mounted upon the upper surface of said sailboard hull.

5. The apparatus of claim 3 further comprising means operatively associated with said lip portion for raising said skeg from said first position towards said second position.

6. The apparatus of claim 1 further including means for prevention of upward vertical movement of the skeg beyond a predetermined distance corresponding to said second position.

7. The apparatus of claim 6 wherein said skeg upward movement prevention means comprises a strap member connecting said skeg to said housing.

8. The apparatus of claim 1 whereas said skeg includes means located on the upper end thereof for raising or retracting said skeg from said first position towards said second position.

9. The apparatus of claim 8 wherein said skeg includes a lip portion on the upper end thereof, and wherein said skeg retracting means comprises a strap member connected to said lip portion.

10. The apparatus of claim 1 wherein said housing further comprises means for contacting said skeg to further reduce said air entrainment.

11. The apparatus of claim 10 wherein said contacting means comprises a flexible seal member.

12. The apparatus of claim 11 wherein said flexible seal member comprises resilient polyurethane foam.

13. The apparatus of claim 1 further comprising means for raising said skeg from said first position towards said second position.

14. A wind propelled sailing apparatus comprising a sailboard hull adapted to support a user; means for propulsion of said sailboard hull and adapted to receive wind for motive power; a skeg positioned and oriented in a rear central portion of said sailboard hull, said skeg being adjustable between a first position, whereby said skeg has a surface area sufficient to provide lateral resistance to side forces generated by said propulsion means and to provide directional stability to said sailboard hull when sailing upwind, and a second position, whereby the area of the skeg is reduced for sailing downwind; and means for housing said skeg and facilitating vertical upward and downward movement thereof, said housing means having an opening configured and positioned about said skeg and in contact therewith to minimize air entrainment between said housing opening and skeg to the underside of the sailboard hull due to forward movement thereof and to prevent water from being forced upward through the housing opening from beneath the sailboard hull; means for prevention of downward vertical movement of said skeg beyond a predetermined distance corresponding to said first position, said skeg downward movement prevention means comprising a lip portion located on an upper surface of said skeg and a seat member located within said housing opening, wherein said lip portion has wider dimensions than said seat member; and means for prevention of upward vertical movement of said skeg beyond a predetermined distance corresponding to said second position.

15. A wind propelled sailing apparatus comprising a sailboard hull adapted to support a user; means for propulsion of said sailboard hull and adapted to receive wind for motive power; a skeg positioned and oriented in a rear central portion of said sailboard hull, said skeg having a lip portion located on an upper surface thereof to facilitate upward movement and being adjustable between a first position, whereby said skeg has a surface area sufficient to provide lateral resistance to side forces generated by said propulsion means and to provide directional stability to said sailboard hull when sailing upwind, and a second position, whereby the area of the skeg is reduced for sailing downwind; and means for housing said skeg and facilitating vertical upward and downward movement thereof, said housing means having an opening configured and positioned about said skeg to minimize air entrainment between said housing opening and skeg to the underside of the sailboard hull due to forward movement thereof and to prevent water from being forced upward through the housing opening from beneath the sailboard hull; and skeg raising means comprising an L-shaped foot control operatively associated with said skeg lip portion and pivotably mounted upon said sailboard hull; wherein said L-shaped foot control is not attached to the skeg and only provides an upward force when operated by the user.

16. The apparatus of claim 15 wherein said foot control includes a U-shaped foot pedal and a pair of arm members attached thereto at a predetermined angle.

17. A wind propelled sailing apparatus comprising a sailboard hull adapted to support a user; means for propulsion of said sailboard hull and adapted to receive wind for motive power; a skeg positioned and oriented in a rear central portion of said sailboard hull as the sole means for providing lateral resistance and dimensional control for the apparatus, said skeg being vertically slidably movable and slidably adjustable between a first position, whereby said skeg has a surface area sufficient to provide lateral resistance to side forces generated by said propulsion means and to provide directional stability to said sailboard hull when sailing upwind, and a second position, whereby the area of the skeg is reduced for sailing downwind; means for housing said skeg and facilitating vertical upward and downward sliding movement thereof, said housing means having an opening configured and positioned about said skeg to minimize air entrainment between said housing opening and skeg to the underside of the hull due to forward movement thereof and to prevent water from being forced upward through the housing opening from beneath the sailboard hull; said skeg further including means for prevention of downward vertical sliding movement of said skeg beyond a predetermined distance corresponding to said first position, and means for prevention of upward vertical sliding movement of said skeg beyond a predetermined distance corresponding to said second position.

18. The apparatus of claim 17 wherein said skeg downward movement prevention means comprises a lip portion on the upper end of said skeg and a seat member associated with said housing opening.

19. The apparatus of claim 18 wherein said skeg downward movement prevention means further comprises a pad member mounted upon the upper surface of said sailboard hull.

20. The apparatus of claim 18 wherein said skeg downward movement prevention means further comprises a seat member located within said housing opening.

21. The apparatus of claim 17 wherein said skeg upward movement prevention means comprises a strap member connecting said skeg to said housing.

22. The apparatus of claim 17 whereas said skeg includes means located on the upper end thereof for raising or retracting said skeg from said first position to said second position.

23. The apparatus of claim 22 wherein said skeg retracting means comprises a strap member connected to said lip portion.

24. The apparatus of claim 17 wherein said housing further comprises means for contacting said skeg to further reduces said air entrainment and water flow in said housing opening, said contacting means comprising a seal member.

25. A wind propelled sailing apparatus comprising a sailboard hull adapted to support a user; means for propulsion of said sailboard hull and adapted to receive wind for motive power; a skeg having a lip portion located on an upper surface thereof, said skeg being positioned and oriented in a rear central portion of said sailboard hull, said skeg being adjustable between a first position, whereby said skeg has a surface area sufficient to provide lateral resistance to side forces generated by said propulsion means and to provide directional stability to said sailboard hull when sailing upwind, and a second position, whereby the area of the skeg is reduced for sailing downwind; and means for housing said skeg and facilitating vertical upward and downward movement thereof, said housing means having an opening configured and positioned about said skeg to minimize air entrainment between said housing opening and skeg to the underside of the hull due to forward movement thereof and to prevent water from being forced upward through the housing opening from beneath the sailboard hull; and means operatively associated with said skeg lip portion for raising said skeg from said first position to said second position; said skeg raising means comprising an L-shaped foot control pivotably mounted upon said sailboard hull and having a U-shaped foot pedal and a pair of arm members attached thereto at a predetermined angle.

26. The apparatus of claim 25 further comprising means for prevention of downward vertical movement of said skeg beyond a predetermined distance corresponding to said first position, and means for prevention of upward vertical movement of said skeg beyond a predetermined distance corresponding to said second position.

27. A wind propelled sailing apparatus consisting essentially of a sailboard hull having substantially flat top and bottom surfaces and adapted to support a user; means for propulsion of said sailboard hull and adapted to receive wind for motive power; a skeg positioned and oriented in a rear central portion of said sailboard hull, said skeg being vertically slidably moveable and slidably adjustable between a first position, whereby said skeg has a surface area sufficient to provide lateral resistance to side forces generated by said propulsion means and to provide directional stability to said sailboard hull when sailing upwind, and a second position, whereby the area of the skeg is reduced for sailing downwind; means for housing said skeg and facilitating vertical upward and downward sliding movement thereof, said housing means having an opening configured and positioned about said skeg to minimize air entrainment between said housing opening and skeg to the underside of the hull due to forward movement thereof and to prevent water from being forced upward through the housing opening from beneath the sailboard hull; said skeg further including means operatively associated with said housing opening for prevention of downward vertical sliding movement of said skeg beyond a predetermined distance corresponding to said first position; and means operatively associated with said housing opening for prevention of upward vertical sliding movement of said skeg beyond a predetermined distance corresponding to said second position.

28. The apparatus of claim 27 further comprising means for raising said skeg from said first position toward said second position to vary the surface area of said skeg provided beneath said hull.

29. The apparatus of claim 28 wherein said skeg raising means comprises a first strap member attached to the skeg.

30. The apparatus of claim 27 wherein said skeg upward movement prevention means comprises a second strap member connecting said skeg to said housing.

31. The apparatus of claim 27 wherein said skeg is the sole means for providing lateral resistance and dimension control for the apparatus, and wherein said housing further comprises means for contacting said skeg to further reduce said air entrainment.

32. The apparatus of claim 27 wherein said contacting means comprises a flexible polyurethane foam member surrounding and capable of conforming to the shape of said skeg to provide an air-tight seal therearound.

* * * * *